US012305870B2

(12) United States Patent
Takaki et al.

(10) Patent No.: US 12,305,870 B2
(45) Date of Patent: May 20, 2025

(54) SETTING SCREEN DISPLAYING A LIST OF AIR CONDITIONER IDENTIFIERS INSTALLED, ON/OFF FAN CONTROL, AIRFLOW DIRECTION, AND ADDRESS INFORMATION OF MULTIPLE INDOOR UNITS AND OUTDOOR UNITS

(71) Applicant: DAIKIN INDUSTRIES, LTD., Osaka (JP)

(72) Inventors: Kentarou Takaki, Osaka (JP); Nobuyoshi Kawakami, Osaka (JP); Nao Okada, Osaka (JP); Hiroko Kashimoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 420 days.

(21) Appl. No.: 17/759,653

(22) PCT Filed: Dec. 14, 2020

(86) PCT No.: PCT/JP2020/046488
§ 371 (c)(1),
(2) Date: Jul. 28, 2022

(87) PCT Pub. No.: WO2021/161641
PCT Pub. Date: Aug. 19, 2021

(65) Prior Publication Data

US 2023/0069438 A1 Mar. 2, 2023

(30) Foreign Application Priority Data

Feb. 12, 2020 (JP) ..... 2020-021752

(51) Int. Cl.
*F24F 11/52* (2018.01)
*F24F 11/54* (2018.01)
(Continued)

(52) U.S. Cl.
CPC ..... *F24F 11/52* (2018.01); *F24F 11/54* (2018.01); *F24F 11/57* (2018.01); *F24F 11/58* (2018.01); *F24F 11/59* (2018.01); *F24F 11/89* (2018.01)

(58) Field of Classification Search
CPC .. F24F 11/52; F24F 11/54; F24F 11/57; F24F 11/58; F24F 11/59; F24F 11/89; F24F 11/61; F24F 11/30
See application file for complete search history.

(56) References Cited

U.S. PATENT DOCUMENTS 9,964,327 B2 5/2018 Masuda et al.
2009/0139251 A1* 6/2009 Masui ..... F24F 11/64 62/129
(Continued)

FOREIGN PATENT DOCUMENTS

JP 2002-027577 1/2002
JP 2009-192149 8/2009
(Continued)

OTHER PUBLICATIONS

Extended European Search Report issued on Jun. 2, 2023 with respect to the related European patent application No. 20918691.5.
(Continued)

*Primary Examiner* — Alicia M. Choi
(74) *Attorney, Agent, or Firm* — IPUSA, PLLC

(57) ABSTRACT

To propose a technique by which an air conditioning device can be efficiently set up. An aspect of the present disclosure relates to a program for implementing, on a terminal, an application that controls a user-side device or a heat-source-side device of an air conditioning device. The program causes the terminal to execute a process including displaying, by the application, a setting screen on the terminal. The setting screen includes identification information, a setting
(Continued)

item, and a drive indicator of the user-side device or the heat-source-side device.

7 Claims, 10 Drawing Sheets

(51) Int. Cl.

| | |
|---|---|
| ***F24F 11/57*** | (2018.01) |
| ***F24F 11/58*** | (2018.01) |
| ***F24F 11/59*** | (2018.01) |
| ***F24F 11/89*** | (2018.01) |

(56) References Cited

U.S. PATENT DOCUMENTS

| | | | | |
|---|---|---|---|---|
| 2010/0256787 | A1* | 10/2010 | Lee | H04L 12/2816 700/90 |
| 2015/0187207 | A1 | 7/2015 | Fujita et al. | |
| 2017/0023271 | A1* | 1/2017 | Nabeshima | F24F 11/62 |
| 2017/0038087 | A1* | 2/2017 | Nabeshima | F24F 11/523 |
| 2017/0191689 | A1* | 7/2017 | Fujihira | F25B 49/005 |
| 2018/0202682 | A1* | 7/2018 | Park | F24F 11/58 |

FOREIGN PATENT DOCUMENTS

| | | | |
|---|---|---|---|
| JP | 2010-028377 | 2/2010 | |
| JP | 2014-160382 | 9/2014 | |
| JP | 2017-017554 | 1/2017 | |
| JP | 2017-163609 | 9/2017 | |
| JP | 2018-113557 | 7/2018 | |
| KR | 10-2009-0080745 | 7/2009 | |
| KR | 2019038056 A * | 4/2019 | F24F 11/30 |

OTHER PUBLICATIONS

International Search Report for PCT/JP2020/046488 mailed on Feb. 9, 2021.

International Preliminary Report on Patentability for PCT/JP2020/046488 mailed on Aug. 25, 2022.

* cited by examiner

FIG.3

| FAN | DEVICE | ADDRESS |
|---|---|---|
| ON | Unit 01 | 1-01▼ |
| ON | Unit 02 | 1-02▼ |
| ON | Unit 03 | 1-03▼ |
| ON | Unit 04 | 2-00▼ |
| ON | Unit 05 | 2-01▼ |
| ON | Unit 06 | 2-02▼ |
| ON | Unit 07 | 2-03▼ |
| ON | Unit 08 | 2-04▼ |
| ON | Unit 09 | 3-00▼ |
| ON | Unit 10 | 4-01▼ |
| ON | Unit 11 | 4-03▼ |

FIG.4

| FAN | DEVICE | ADDRESS |
|---|---|---|
| ON | Unit 01 | 1-01▼ |
| ON | Unit 02 | 1-02▼ |
| ON | Unit 03 | 1-03▼ |
| ON | Unit 04 | 2-00▼ |
| ON | Unit 05 | 2-01▼ |
| ON | Unit 06 | 2-02▼ |
| ON | Unit 07 | 2-03▼ |
| ON | Unit 08 | 2-04▼ |
| ON | Unit 09 | 3-00▼ |
| ON | Unit 10 | 4-01▼ |
| ON | Unit 11 | 4-03▼ |

FIG.5

| FAN | DEVICE | ADDRESS |
|---|---|---|
| ON | Unit 01 | 1-01▼ |
| ON | Unit 02 | 1-02▼ |
| ON | Unit 03 | 1-03▼ |
| ON | Unit 04 | 2-00▼ |
| ON | Unit 05 | 2-01▼ |

APPLY

| |
|---|
| 8-14 |
| 8-15 |
| 1-00 |
| 1-01 |
| 1-02 |
| 1-03 |

FIG.6

| FAN | DEVICE | ADDRESS |
|---|---|---|
| ON | Unit 01 | 3-01▼ |
| ON | Unit 02 | 1-02▼ |
| ON | Unit 03 | 1-03▼ |
| ON | Unit 04 | 2-00▼ |
| ON | Unit 05 | 2-01▼ |

APPLY

| |
|---|
| 2-14 |
| 2-15 |
| 3-00 |
| 3-01 |
| 3-02 |
| 3-03 |

FIG.7

| FAN | DEVICE | AIRFLOW DIRECTION |
|---|---|---|
| ON | Unit 01 | |
| ON | Unit 02 | |
| ON | Unit 03 | |
| ON | Unit 04 | |
| ON | Unit 05 | |
| ON | Unit 06 | |
| ON | Unit 07 | |
| ON | Unit 08 | |
| ON | Unit 09 | |
| ON | Unit 10 | |
| ON | Unit 11 | |

FIG.8

| FAN | DEVICE | AIRFLOW DIRECTION |
|---|---|---|
| ON | Unit 01 | |
| ON | Unit 02 | |
| ON | Unit 03 | |
| ON | Unit 04 | |
| ON | Unit 05 | 45 DEGREES▼ |
| ON | Unit 06 | |
| ON | Unit 07 | |
| ON | Unit 08 | |
| ON | Unit 09 | |
| ON | Unit 10 | |
| ON | Unit 11 | |

FIG.9

| FAN | DEVICE | AIRFLOW DIRECTION |
|---|---|---|
| ON | Unit 03 | |
| ON | Unit 04 | |
| ON | Unit 05 | 15 DEGREES▼ |
| ON | Unit 06 | |
| ON | Unit 07 | |

APPLY

| STRAIGHT DOWN |
|---|
| 15 DEGREES |
| 30 DEGREES |
| 45 DEGREES |
| 60 DEGREES |
| 75 DEGREES |

SETTING SCREEN DISPLAYING A LIST OF AIR CONDITIONER IDENTIFIERS INSTALLED, ON/OFF FAN CONTROL, AIRFLOW DIRECTION, AND ADDRESS INFORMATION OF MULTIPLE INDOOR UNITS AND OUTDOOR UNITS

TECHNICAL FIELD

The present disclosure relates to a program and a method for controlling an air conditioning device.

BACKGROUND ART

An air conditioning device (an air conditioner) includes user-side devices and a heat-source-side device. Typically, the user-side devices are installed in an indoor environment, and the heat-source-side device is installed in an outdoor environment. Further, in buildings, facilities, and the like, a large number of air conditioning devices are generally installed, and many user-side devices are installed in various areas of a building.

After air conditioning devices are installed in a building, an installer needs to configure the initial settings of the air conditioning devices.

RELATED-ART DOCUMENTS

Patent Documents

Patent Document 1: Japanese Laid-Open Patent Publication No. 2017-163609

SUMMARY OF THE INVENTION

Problem to be Solved by the Invention

The present disclosure proposes a technique by which an air conditioning device can be efficiently set up.

Means to Solve the Problem

An aspect of the present disclosure relates to a program for implementing, on a terminal, an application that controls a user-side device or a heat-source-side device of an air conditioning device. The program causes the terminal to execute a process including displaying, by the application, a setting screen on the terminal. The setting screen includes identification information, a setting item, and a drive indicator of the user-side device or the heat-source-side device.

According to the above aspect, an air conditioning device can be efficiently set up. That is, the drive indicator is displayed on the same screen as the identification information and the setting item. Thus, the user of the application can drive the user-side device or the heat-source-side device without transitioning from the setting screen, and can identify the user-side device or the heat-source-side device that is being driven.

According to an embodiment, the setting screen may include identification information of a plurality of user-side devices and a plurality of heat-source-side devices, setting items of the user-side devices and the heat-source-side devices, and drive indicators of the user-side devices and the heat-source-side devices.

According to an embodiment, the user-side devices and the heat-source-side devices may be provided with the respective drive indicators. The program may further cause the terminal to execute a process of, in response to a drive indicator of a second device being set to an on state while a drive indicator of a first device is already set to an on state, driving, by the application, a fan of the second device, and stopping, by the application, a fan of the first device.

According to the above embodiment, a plurality of air conditioning devices can be efficiently set up.

According to an embodiment, the setting item may be an airflow direction of the user-side device.

According to an embodiment, the setting item may be an address of the user-side device or of the heat-source-side device.

According to the above embodiment, an airflow direction and an address can be set for an air conditioning device.

According to an embodiment, the program may further cause the terminal to execute a process of setting, by the application, the drive indicator to an off state in a case where the terminal is not operated for a predetermined period of time after the drive indicator is set to an on state.

According to an embodiment, the program may further cause the terminal to execute a process of transmitting, by the application, both setting information relating to the setting item of the user-side device or the heat-source-side device and a drive command for driving an actuator of the user-side device or of the heat-source-side device to a remote controller, and stopping, by the application, the driving of the actuator in response to a predetermined period of time elapsing after communication with the remote controller is disconnected.

According to the above embodiment, a situation in which the installer forgets to turn off the actuator after being turned on can be avoided.

According to an embodiment, the drive indicator may instruct an actuator of the user-side device or of the heat-source-side device to be driven in a visually recognizable manner by an installer.

According to an embodiment, the drive indicator may instruct a fan of the user-side device or of the heat-source-side device to be driven.

According to the above embodiment, the installer can identify an air conditioning device whose fan is being driven.

Another aspect of the present disclosure relates to a control method performed by a terminal having an application that controls a user-side device or a heat-source-side device of an air conditioning device. The method includes a step of displaying, by the application, a setting screen on the terminal. The setting screen includes identification information, a setting item, and a drive indicator of the user-side device or the heat-source-side device.

According to the above aspect, the air conditioning device can be efficiently set up. That is, the drive indicator is displayed on the same screen as the identification information and the setting item. Thus, the user of the application can drive the user-side device or the heat-source-side device without transitioning from the setting screen, and can identify the user-side device or the heat-source-side device that is being driven.

BRIEF DESCRIPTION OF THE DRAWINGS

FIG. 3 is a diagram illustrating an address setting screen according to an embodiment of the present disclosure;

FIG. 4 is a diagram illustrating the address setting screen according to the embodiment of the present disclosure;

FIG. 5 is a diagram illustrating the address setting screen according to the embodiment of the present disclosure;

FIG. 6 is a diagram illustrating the address setting screen according to the embodiment of the present disclosure;

FIG. 7 is a diagram illustrating an airflow direction setting screen according to an embodiment of the present disclosure;

FIG. 8 is a diagram illustrating the airflow direction setting screen according to the embodiment of the present disclosure;

FIG. 9 is a diagram illustrating the airflow direction setting screen according to the embodiment of the present disclosure.

MODE FOR CARRYING OUT THE INVENTION

In the following, embodiments will be described.

Control System

In the following embodiments of the present disclosure, a control system that uses a remote controller and a terminal, such as a smartphone or a tablet, to set and control an air conditioning device is disclosed. The remote controller controls the air conditioning device, and the terminal sets the air conditioning device through the remote controller.

Figure 1:
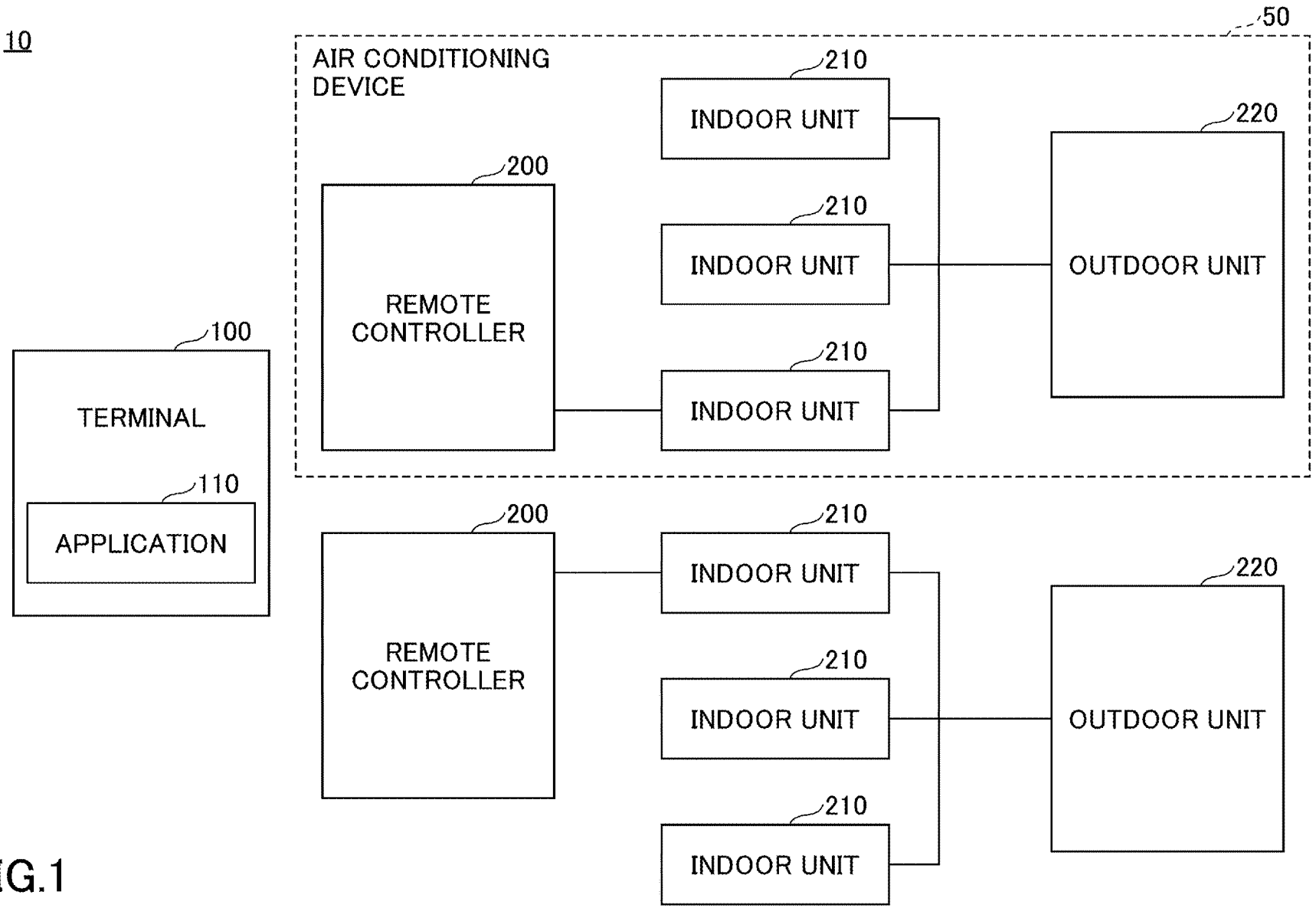
FIG. 1 is a schematic diagram illustrating a control system according to an embodiment of the present disclosure.

As illustrated in FIG. 1, a control system 10 according to an embodiment of the present disclosure includes a plurality of air conditioning devices (air conditioners) 50, remote controllers 200 that control the air conditioning devices 50, and a terminal 100 that uses a pre-installed application 110 to set and control the plurality of air conditioning devices 50 through the remote controllers 200. The terminal 100 and the remote controllers 200, which are communicatively connected, are used by an installer, i.e., a person who performs installations, to configure the initial settings of the air conditioning devices 50 when the air conditioning devices 50 are installed. After the air conditioning devices 50 are installed, the terminal 100 and the remote controllers 200 are used by an administrator who manages the air conditioning devices 50. For example, when the air conditioning devices 50 are installed, the installer configures the initial settings such as addresses of user-side devices (indoor units) 210 and heat-source-side devices (outdoor units) 220 and airflow directions suitable for the installation locations of the user-side devices 210.

Note that the following embodiments focus on setting and controlling the air conditioning devices 50 by the terminal 100 and the remote controllers 200; however, the control system 10 according to the present disclosure is not limited thereto, and may be applied to any other embodiment in which two or more control apparatuses, which are connected in a wired or wireless manner, work together to set and control the air conditioning devices 50.

In the control system 10 according to the following embodiments, the application 110 running on the terminal 100 controls the user-side devices 210 or the heat-source-side devices 220 of the air conditioning devices 50 through the remote controllers 200 that are communicatively connected to the terminal 100. When the installer installs the air conditioning devices 50, the installer operates the application 110, and sets and controls the air conditioning devices 50 by using setting screens displayed on the terminal 100. The setting screens include identification information, setting items (such as airflow directions and addresses), and drive indicators (such as icons and switches for on/off control) of the user-side devices 210 or the heat-source-side devices 220.

Specifically, for example, from among the plurality of air conditioning devices 50 installed in a specific area (for example, a floor or a section that is a setting target area by the installer) and to which addresses are not assigned, the installer can cause a given air conditioning device 50 to operate its actuator by operating a setting screen, displayed as a single screen on the terminal 100, and pressing a corresponding drive indicator or the like, thereby allowing the installer to check the position of the given air conditioning device 50. Accordingly, while checking the position of each of the air conditioning devices 50, the installer can configure the initial settings of each of the air conditioning devices 50 without a screen transition.

Figure 2:
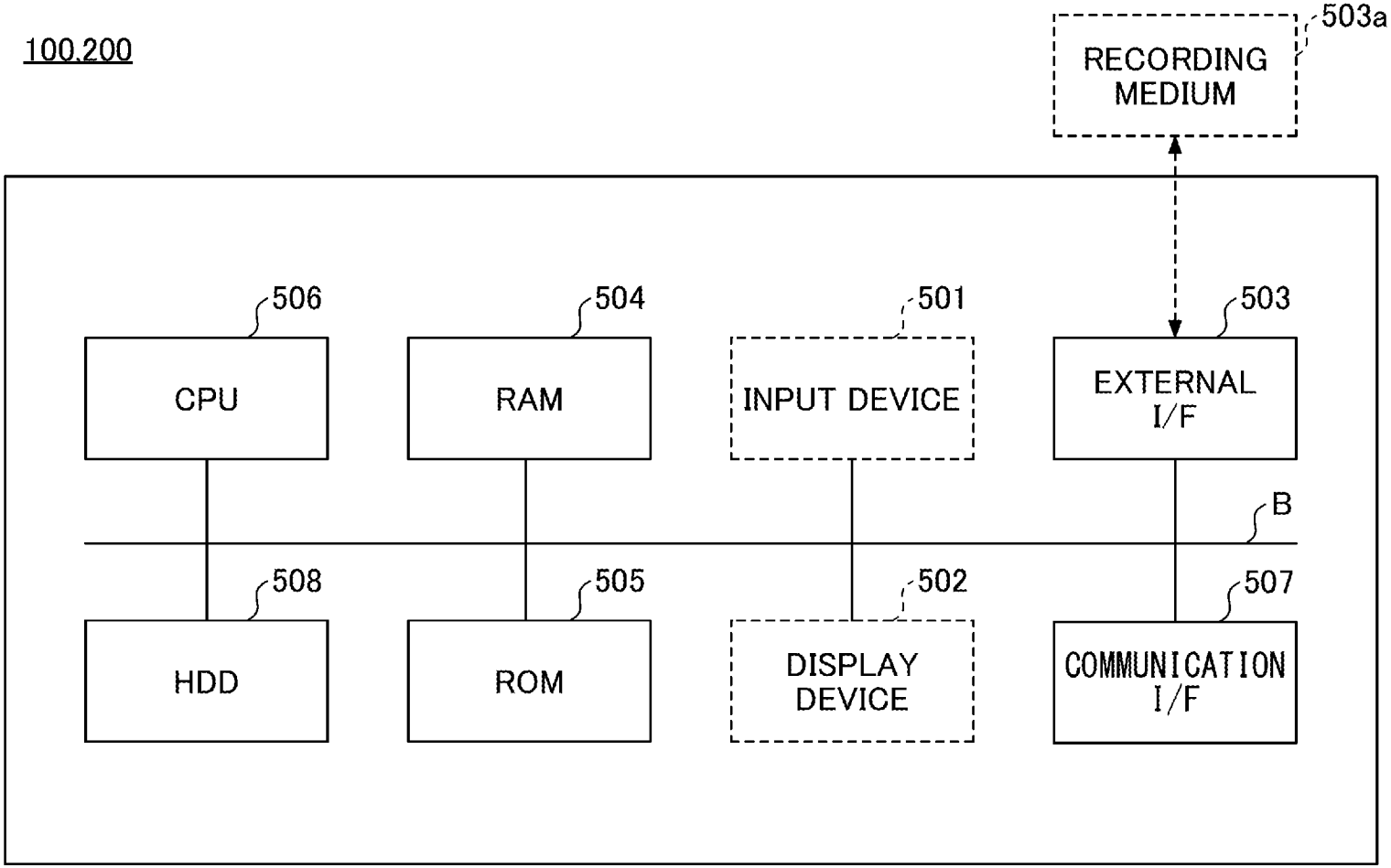
FIG. 2 is a block diagram illustrating a hardware configuration of each of a terminal and a remote controller according to an embodiment of the present disclosure.

Each of the terminal 100 and a remote controller 200 may have a hardware configuration as illustrated in FIG. 2, for example. That is, each of the terminal 100 and the remote controller 200 may include an input device 501, a display device 502, an external interface (I/F) 503, a random-access memory (RAM) 504, a read-only memory (ROM) 505, a central processing unit (CPU) 506, a communication interface (I/F) 507, and a hard disk drive (HDD) 508, which are connected to each other via a bus B. Further, the input device 501 and the display device 502 may be connected to the bus B when necessary.

The input device 501 includes a touch panel, operation keys, buttons, a keyboard, a mouse, and the like, and is used by a user to input various signals. The display device 502 includes a display such as a liquid crystal display or an organic EL display for displaying a screen, a speaker for outputting sound data such as sound and music. The communication I/F 507 is an interface that connects the terminal 100 or the remote controller 200 to a network. With this configuration, the terminal 100 or the remote controller 200 can perform data communication via the communication I/F 507.

The HDD 508 is an example of a non-volatile storage device that stores programs and data. Examples of the programs and the data stored in the HDD 508 include an operating system (OS), which is basic software controlling the entirety of the terminal 100 or the remote controller 200, and applications running on the OS and providing various functions.

Note that instead of the HDD 508, the terminal 100 or the remote controller 200 may use a drive device (e.g., a solid state drive (SSD)) that uses a flash memory as a storage medium.

The external I/F 503 is an interface with an external device. The external device may be a recording medium 503*a* or the like. With this configuration, the terminal 100 or the remote controller 200 can read from and write to the recording medium 503*a* via the external I/F 503. Examples of the recording medium 503*a* include a flexible disk, a compact disc (CD), a digital versatile disc (DVD), a SD memory card, and a universal serial bus (USB) memory.

The ROM 505 is an example of a non-volatile semiconductor memory (a storage device) that can retain programs and data even when the power is turned off. The ROM 505 stores programs and data such as a basic input/output system (BIOS), which is executed when the terminal 100 or the remote controller 200 is started, OS settings, and network settings. The RAM 504 is an example of a volatile semiconductor memory (storage device) that temporarily stores programs and data.

The CPU 506 is an arithmetic unit that implements control and functions of the entirety of terminal 100 or the remote controller 200 by reading programs and data from a storage device such as the ROM 505 or the HDD 508 into the RAM 504 and performing processes.

However, each of the terminal 100 and the remote controller 200 does not necessarily have the above-described hardware configuration, and may have any other hardware configuration such as an appropriate circuit.

Application

Next, the application 110 according to an embodiment of the present disclosure will be described. The application 110 controls the user-side devices 210 or the heat-source-side devices 220 of the air conditioning devices 50. The application 110 is executed by the CPU 506 of the terminal 100. Note that the application 110 may be executed by a processor such as an MPU.

The application 110 displays, on the display device of the terminal 100, a setting screen that includes identification information, setting items, and drive indicators of the user-side devices 210 or the heat-source-side devices 220. Specifically, upon the installer starting the application 110 on the terminal 100 in order to configure the initial settings of the air conditioning devices 50 installed in a building or the like, the application 1101 displays, on the display device of the terminal 100, a setting screen for setting items such as addresses or airflow directions of the air conditioning devices 50. In response to an operation performed by the installer on the setting screen, the application 110 obtains details of the operation performed by the installer.

The application 110 transmits the details of the operation performed on the setting screen to the remote controller 200. Specifically, in response to an operation being performed by the installer on the setting screen, such as pressing a button, operating a toggle switch, or selecting a selection menu on the setting screen, the application 110 transmits details of the operation to the remote controller 200.

Address Setting Screen

Next, referring to FIG. 3 through FIG. 6, an address setting screen according to an embodiment of the present disclosure will be described. FIG. 3 through FIG. 6 are diagrams illustrating an example transition of an address setting screen.

For example, in order for the installer to set addresses of the air conditioning devices 50 that have been installed, the application 110 first displays a setting screen, as illustrated in FIG. 3, on the display device of the terminal 100. The setting screen illustrated in FIG. 3 displays drive indicators for turning fans on or off, identification information for identifying the user-side devices 210 and the heat-source-side devices 220, and buttons for setting addresses of the air conditioning devices 50. As illustrated in FIG. 1, each of the air conditioning devices 50 includes user-side devices 210, such as indoor units, and a heat-source-side device 220, such as an outdoor unit, that supplies conditioned air to the user-side devices 210. At the time of shipment from a factory, identification information is individually assigned to each of the air conditioning devices 50, which includes the user-side devices 210, the heat-source-side device 220, and the like, and the identification information is transmitted from each of the installed air conditioning devices 50 to a controller such as a remote controller 200.

In the specific example illustrated in FIG. 3, identification information "Unit 01" to identification information "Unit 11" assigned to eleven respective air conditioning devices 50 are displayed. The identification information of the air conditioning devices 50 are not initially associated with the actual installation positions of the air conditioning devices 50. Therefore, it is common to set addresses of the air conditioning devices 50 for management before the air conditioning devices 50 are operated. For example, a plurality of air conditioning devices 50 installed in a given area may be classified into a group, and addresses that can identify both the group and the individual air conditioning devices 50 may be set.

In the example of the setting screen illustrated in FIG. 3, addresses "1-01", "1-02, and the like are pre-assigned to the air conditioning devices 50 in advance. However, the setting screen according to the present disclosure is not limited thereto, and the address fields may be initially blank and the installer may set specific addresses.

Typically, at the time of the initial settings after the air conditioning devices 50 are installed, the installer is assumed to be unable to identify which identification information is assigned to which air conditioning device 50. Therefore, the installer causes an air conditioning device 50 to start an operation that is visually recognizable by the installer, such as turning on a fan, turning on an LED lamp, or moving a flap. In this manner, the installer identifies the correspondence between the started air conditioning device 50 and identification information. For example, as illustrated in FIG. 4, in order to identify which air conditioning device 50 corresponds to "Unit 01", the installer presses a corresponding drive indicator "fan" icon to set the drive indicator to an on state. In response to the installer pressing the "fan" icon, the application 110 instructs the remote controller 200 to start a fan of the air conditioning device 50 with "Unit 01". In response to the instruction, the remote controller 200 causes the air conditioning device 50 with "Unit 01" to start the fan. In this manner, the installer can identify the air conditioning device 50 whose fan has been started, and can confirm that the identified air conditioning device 50 corresponds to "Unit 01".

Upon identifying the air conditioning device 50 with "Unit 01", as illustrated in FIG. 5, the installer presses a popup button to set an address of "Unit 01", and the application 110 displays a selection screen on which the installer selects an address that can be set for the air conditioning device 50.

For example, as illustrated in FIG. 6, when the installer selects an address of "3-01" on the selection screen and presses an "apply" button, the application 110 instructs the remote controller 200 to set the address of the air conditioning device 50 with "Unit 01" to "3-01". Upon receiving the address setting instruction, the remote controller 200 sets the address of the air conditioning device 50 with "Unit 01" to "3-01".

Similarly, the installer can set addresses of the other air conditioning devices 50 in accordance with the above-described procedure. For example, if a drive indicator of an air conditioning device 50 with "Unit 02" is set to an on state while the drive indicator of the air conditioning device 50 with "Unit 01" is already set to an on state, the application 110 may drive a fan of the air conditioning device 50 with "Unit 02", and may stop the fan of the air conditioning device 50 with "Unit 01". With this configuration, the installer can set the address of the next air conditioning device 50 without switching the fan of the immediately-previously-set air conditioning device 50 to an off state.

Further, if the terminal 100 is not operated for a predetermined period of time after a drive indicator is set to an on state, the application 110 may set the drive indicator to an off state. That is, upon a drive indicator being set to an on state by the installer, the application 110 may start counting a predetermined period of time, and if no operation is performed by the installer on the terminal 100 for the predetermined period of time, the application 110 may switch the drive indicator to an off state. In this case, the application 110 instructs the remote controller 200 to set an actuator such as a fan, which is being driven, to an off state. Accordingly, a situation in which the installer forgets to turn off the fan or the like can be avoided.

According to the above-described embodiment, the installer can cause an air conditioning device 50, to which an address is not assigned, to perform a recognizable operation by operating the setting screen, displayed on the terminal 100 as a single screen, and by pressing a drive indicator "fan" or the like. Accordingly, while checking the installation position of the air conditioning device 50, the installer can set the address of the air conditioning device 50 without a screen transition.

Further, for example, the installer can group a plurality of air conditioning devices 50 installed in the same section of an area, and set a group address and a device address for each of the air conditioning devices 50 (for example, in the above-described address "3-01", "3" may represent a group address and "01" may represent a device address.).

Airflow Direction Setting Screen

Next, referring to FIG. 7 through FIG. 9, an airflow direction setting screen according to an embodiment of the present disclosure will be described. FIG. 7 through FIG. 9 are diagrams illustrating an example transition of an airflow direction setting screen.

For example, in order for the installer to set addresses of air conditioning devices 50 that have been installed, the application 110 first displays a setting screen, as illustrated in FIG. 7, on the display device of the terminal 100. The setting screen illustrated in FIG. 7 displays drive indicators for turning fans on or off of the air conditioning devices 50 and blank fields for setting airflow directions.

In the example of the setting screen illustrated in FIG. 7, airflow directions of the air conditioning devices 50 are not assigned. However, the setting screen according to the present disclosure is not limited thereto, and default airflow directions may be initially displayed.

Typically, at the time of the initial settings after the air conditioning devices 50 are installed, the installer causes an air conditioning device 50 to start an operation that is visually recognizable by the installer, such as turning on a fan, turning on an LED lamp, or moving a flap. In this manner, the installer can check the correspondence between the started air conditioning device 50 and identification information. For example, as illustrated in FIG. 8, in order to identify which air conditioning device 50 corresponds to "Unit 05", the installer presses a corresponding drive indicator "fan" icon to set the drive indicator to an on state. In response to the installer pressing the "fan" icon, the application 110 instructs the remote controller 200 to start a fan of the air conditioning device 50 with "Unit 05". In response to the instruction, the remote controller 200 causes the air conditioning device 50 with "Unit 05" to start the fan. In this manner, the installer can identify the air conditioning device 50 whose fan has been started, and can confirm that the identified air conditioning device 50 corresponds to "Unit 05".

Further, in response the "fan" icon being pressed by the installer, as illustrated in FIG. 9, the application 110 displays a selection screen on which the installer selects an airflow direction of "Unit 05".

For example, as illustrated in FIG. 9, upon the installer selecting an airflow direction of "15 degrees" and pressing an "apply" button, the application 110 instructs the remote controller 200 to set the airflow direction of the air conditioning device 50 with "Unit 05" to "15 degrees". In response to receiving the airflow direction setting instruction, the remote controller 200 sets the airflow direction of the air conditioning device 50 with "Unit 05" to "15 degrees".

Similarly, the installer can set airflow directions of the other air conditioning devices 50 in accordance with the above-described procedure. For example, if a drive indicator of an air conditioning device 50 with "Unit 06" is set to an on state while the drive indicator of the air conditioning device 50 with "Unit 05" is already set to an on state, the application 110 may drive a fan of the air conditioning device 50 with "Unit 06", and may stop the fan of the air conditioning device 50 with "Unit 05". With this configuration, the installer can set the airflow direction of the next air conditioning device 50 without switching the fan of the immediately-previously-set air conditioning device 50 to an off state.

Further, if the terminal 100 is not operated for a predetermined period of time after a drive indicator is set to an on state, the application 110 may set the drive indicator to an off state. That is, upon a drive indicator being set to an on state by the installer, the application 110 may start counting a predetermined period of time, and if no operation is performed by the installer on the terminal 100 for the predetermined period of time, the application 110 may switch the drive indicator to an off state. In this case, the application 110 instructs the remote controller 200 to set an actuator such as a fan, which is being driven, to an off state. Accordingly, a situation in which the installer forgets to turn off the fan can be avoided.

According to the above-described embodiment, the installer can cause an air conditioning device 50 for which an airflow direction is not set, to perform a recognizable operation by operating the setting screen, displayed on the terminal 100 as a single screen, and pressing a drive indicator "fan" or the like. Accordingly, while checking the installation position of the air conditioning device 50, the installer can set the airflow direction of the air conditioning device 50 without a screen transition.

Control Process

Next, referring to FIG. 10, a control process according to an embodiment of the present disclosure will be described. The control process is executed by the terminal 100 and the remote controller 200 of the above-described control system 10. More specifically, the control process is executed by processors of the terminal 100 and of the remote controller 200.

Figure 10:
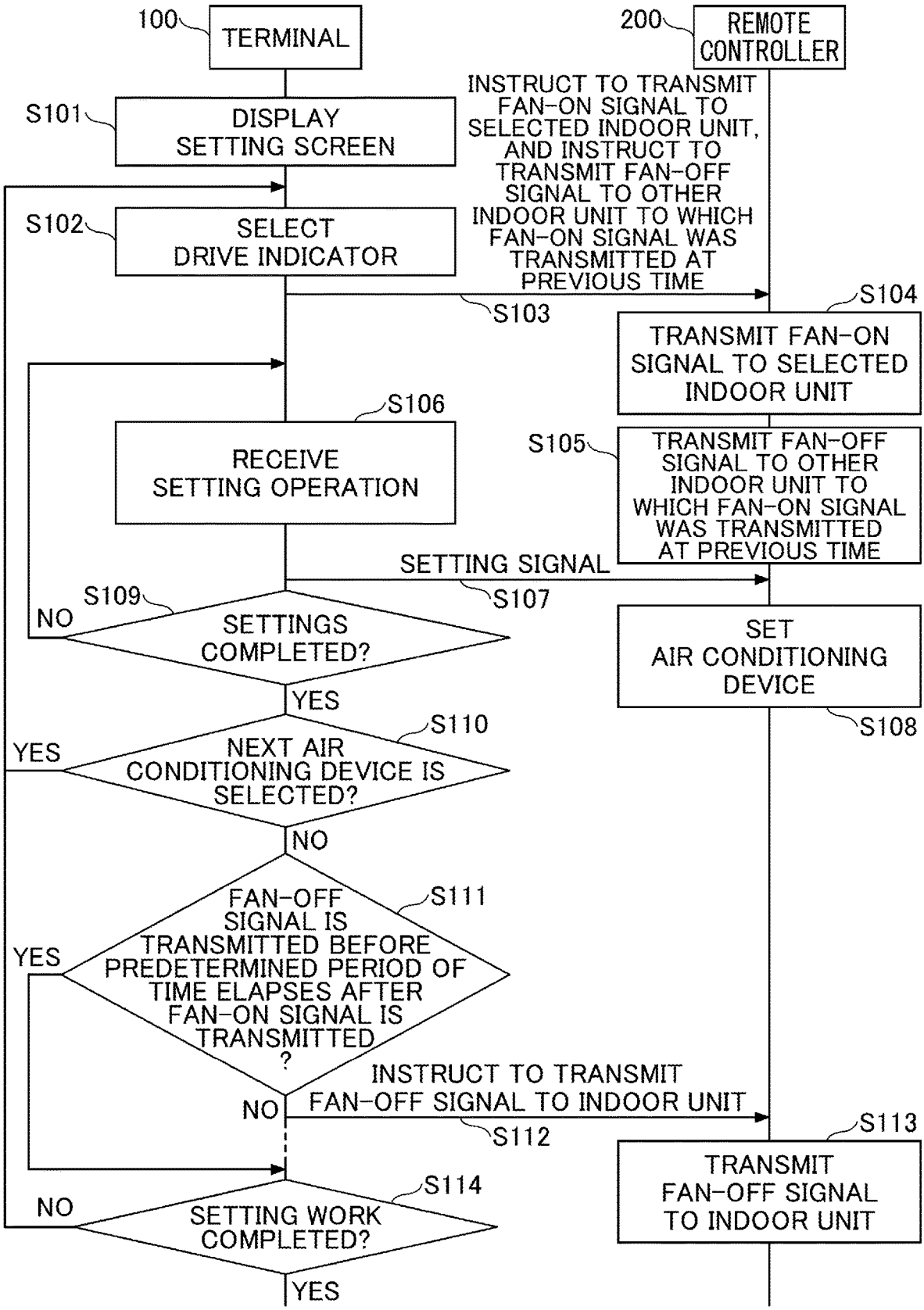
FIG. 10 is a sequence diagram illustrating a control process according to an embodiment of the present disclosure.

FIG. 10 is a sequence diagram illustrating a control process according to an embodiment of the present disclosure. As illustrated in FIG. 10, in step S101, the terminal 100 displays a setting screen for air conditioning devices 50. Specifically, upon the installer logging into the application 110 and selecting a setting item for air conditioning devices 50, the application 110 displays a setting screen for setting the selected setting item. The setting screen includes identification information, setting items, and drive indicators of user-side devices 210 or heat-source-side devices 220. For example, upon the installer selecting an address as a setting item, a setting screen as illustrated in FIG. 3 may first be displayed by the application 110. Further, upon the installer selecting an airflow direction as a setting item, a setting screen as illustrated in FIG. 7 may first be displayed by the application 110.

In step S102, upon the installer selecting "fan" of any of the air conditioning devices 50 (for example, a given user-side device 210) displayed on the setting screen and setting the drive indicator to an on state, the application 110 receives the selection of the drive indicator "fan" of the user-side device 210.

In step S103, the application 110 instructs the remote controller 200 to transmit a fan-on signal to the selected user-side device 210. If a fan-on signal was transmitted to any other user-side device 210 at the previous time, the application 110 instructs the remote controller 200 to transmit a fan-off signal to the other user-side device 210.

In step S104, the remote controller 200 transmits the fan-on signal to the user-side device 210 selected by the installer. Further, in step S105, the remote controller 200 transmits the fan-off signal to the other user-side device 210 selected by the installer at the previous time.

In step S106, the application 110 receives a setting operation performed by the installer on the setting screen. For example, if the installer sets the address of the air conditioning device 50 with "Unit 01" on the address setting screen, the application 110 receives the setting operation.

In step S107, the terminal 100 transmits a setting signal corresponding to the received setting operation to the remote controller 200. For example, the terminal 100 transmits a setting signal for setting an address specified by the installer for the air conditioning device 50 with "Unit 01", which corresponds to the received address setting operation, to the remote controller 200.

In step S108, the remote controller 200 set the specified address of the air conditioning device 50 in accordance with the received setting signal.

In step S109, the application 110 determines whether any further setting operation is performed. If the application 110 does not receive a further setting operation, the application 110 determines that the settings of the air conditioning device 50 with "Unit 01" have been completed (YES in S109), and causes the process to proceed to step S110. Conversely, if the application 110 receives a further setting operation, the application 110 determines that the settings of the air conditioning device 50 with "Unit 01" have not been completed (NO in S109), causes the process to return to step S106, and repeats the above-described steps.

In step S110, the application 110 determines whether the next air conditioning device 50 is selected by the installer. If the next air conditioning device 50 is selected by the installer (YES in S110), the application 110 causes the process to return to step S102 and repeats the above-described steps. Conversely, if the next air conditioning device 50 is not selected by the installer (NO in S110), in step S111, the application 110 determines whether a fan-off signal is transmitted to the selected user-side device 210 before a predetermined period of time elapses after the fan-on signal is transmitted in step S103. If a fan-off signal is transmitted to the selected user-side device 210 before a predetermined period of time elapses after the fan-on signal is transmitted (YES in S111), the application 110 determines whether setting work by the installer is completed in step S115. If setting work for the air conditioning devices 50 by the installer is completed (YES in S114), the application 110 ends the control process. Conversely, if the setting work for the air conditioning devices 50 by the installer is not completed (NO in S114), the application 110 causes the process to return to step S102 and repeats the above-described steps.

Conversely, if a fan-off signal is not transmitted to the selected user-side device 210 before a predetermined period of time elapses after the fan-on signal is transmitted (NO in S111), the application 110 instructs the remote controller 200 to transmit a fan-off signal to the user-side device 210 in step S112. Upon receiving the instruction, in step S113, the remote controller 200 transmits the fan-off signal to the user-side device 210 that remains in an on state.

Although the embodiments have been described above, it will be understood that various modifications may be made to the configurations and details without departing from the spirit and scope of the claims.

This application is based on and claims priority to Japanese Patent Application No. 2020-021752, filed on Feb. 12, 2020, the entire contents of which are incorporated herein by reference.

DESCRIPTION OF THE REFERENCE NUMERALS 10 control system
50 air conditioning device (air conditioner)
100 terminal
110 application
200 remote controller
210 user-side device (indoor unit)
220 heat-source-side device (outdoor unit)

The invention claimed is:

1. A non-transitory recording medium having stored therein a program for implementing, on a terminal, an application that controls a user-side device or a heat-source-side device of an air conditioning device, the program causing the terminal to execute a process comprising:

displaying, by the application, a setting screen on the terminal, the setting screen including identification information of the user-side device or the heat-source-side device, a setting item of the user-side device or the heat-source-side device, and a drive indicator of the user-side device or the heat-source-side device such that the identification information, the setting item, and the drive indicator related to another user-side device or another heat-source-side device are also displayed as a single screen, wherein the setting item is an airflow direction of the user-side device or an address of the user-side device or of the heat-source-side device, and the drive indicator is an icon or a switch for on/off control, wherein the program causes the setting screen to include identification information of a plurality of user-side devices and a plurality of heat-source-side devices, setting items of the user-side devices and the heat-source-side devices, and drive indicators of the user-side devices and the heat-source-side devices, the user-side devices and the heat-source-side devices are provided with the respective drive indicators, and the program further causes the terminal to execute a process of, in response to a drive indicator of a second air conditioning device being set to an on state while a drive indicator of a first air conditioning device is already set to an on state, driving, by the application, a fan of the second air conditioning device, and stopping, by the application, a fan of the first air conditioning device, or the program further causes the terminal to execute a process of transmitting, by the application, both setting information relating to the setting item of the user-side device or the heat-source-side device and a drive command for driving an actuator of the user-side device or of the heat-source-side device to a remote controller, and stopping, by the application, the driving of the actuator in response to a predetermined period of time elapsing after communication with the remote controller is disconnected.

2. The non-transitory recording medium according to claim 1, wherein the setting item is an airflow direction of the user-side device.

3. The non-transitory recording medium according to claim 1, wherein the setting item is an address of the user-side device or of the heat-source-side device.

4. The non-transitory recording medium according to claim 1, wherein the program further causes the terminal to execute a process of setting, by the application, the drive indicator to an off state in a case where the terminal is not operated for a predetermined period of time after the drive indicator is set to an on state.

5. The non-transitory recording medium according to claim 1, wherein the drive indicator instructs an actuator of the user-side device or of the heat-source-side device to be driven in a visually recognizable manner by an installer.

6. The non-transitory recording medium according to claim 1, wherein the drive indicator instructs a fan of the user-side device or of the heat-source-side device to be driven.

7. A control method performed by a terminal having an application that controls a user-side device or a heat-source-side device of an air conditioning device, the method comprising:

displaying, by the application, a setting screen on the terminal, the setting screen including identification information of the user-side device or the heat-source-side device, a setting item of the user-side device or the heat-source-side device, and a drive indicator of the user-side device or the heat-source-side device such that the identification information, the setting item, and the drive indicator related to another user-side device or another heat-source-side device are also displayed as a single screen, wherein setting item is an airflow direction of the user-side device or an address of the user-side device or of the heat-source-side device, and the drive indicator is an icon or a switch for on/off control, wherein the application causes the setting screen to include identification information of a plurality of user-side devices and a plurality of heat-source-side devices, setting items of the user-side devices and the heat-source-side devices, and drive indicators of the user-side devices and the heat-source-side devices, the user-side devices and the heat-source-side devices are provided with the respective drive indicators, and the application further causes the terminal to execute a process of, in response to a drive indicator of a second air conditioning device being set to an on state while a drive indicator of a first air conditioning device is already set to an on state, driving, by the application, a fan of the second air conditioning device, and stopping, by the application, a fan of the first air conditioning device, or the application further causes the terminal to execute a process of transmitting, by the application, both setting information relating to the setting item of the user-side device or the heat-source-side device and a drive command for driving an actuator of the user-side device or of the heat-source-side device to a remote controller, and stopping, by the application, the driving of the actuator in response to a predetermined period of time elapsing after communication with the remote controller is disconnected.

* * * * *